United States Patent [19]

Reeder et al.

[11] Patent Number: 4,961,610

[45] Date of Patent: Oct. 9, 1990

[54] CLAM SHELL ARMREST

[75] Inventors: Ryan A. Reeder, Piqua; David C. Bester, Troy; John H. Oldiges, Minster, all of Ohio

[73] Assignee: Midmark Corporation, Versailles, Ohio

[21] Appl. No.: 396,498

[22] Filed: Aug. 21, 1989

[51] Int. Cl.[5] ..... A47C 7/54

[52] U.S. Cl. ..... 297/412; 297/417

[58] Field of Search ..... 297/417, 411, 412; 248/118, 118.1, 118.5

[56] References Cited

U.S. PATENT DOCUMENTS

| | | | |
|---|---|---|---|
| 939,623 | 11/1909 | Payne et al. . | |
| 1,324,503 | 12/1919 | Hirsch . | |
| 1,644,441 | 10/1927 | O'Brien . | |
| 2,364,261 | 12/1944 | Wood | 297/253 X |
| 2,477,898 | 8/1949 | Rehman et al. . | |
| 2,566,113 | 8/1951 | Bayless . | |
| 3,216,765 | 11/1965 | Junkunc | 297/417 |
| 4,069,995 | 1/1978 | Miller . | |
| 4,277,102 | 7/1981 | Aaras et al. | 297/417 X |
| 4,390,011 | 6/1983 | Evans . | |
| 4,576,351 | 3/1986 | Brink . | |
| 4,784,120 | 11/1988 | Thomas . | |
| 4,815,688 | 3/1989 | Wood | 248/118 X |

*Primary Examiner*—Jose V. Chen

*Attorney, Agent, or Firm*—Biebel, French & Nauman

[57] ABSTRACT

A chair having a seat, an adjustable back, and pivotable armrests. The armrests are pivotally mounted such that a front portion of the armrests may be pivoted in a horizontal plane toward a person seated in the chair. A locking lever is provided such that the rotation of the lever will lock the armrest at a desired position in its pivotal movement.

9 Claims, 4 Drawing Sheets

CLAM SHELL ARMREST

BACKGROUND OF THE INVENTION

The present invention relates to chairs having adjustable armrests and more particularly it relates to a chair having armrests which may be adjusted to allow a person sitting in the chair to rest his or her arms on the armrests while performing a task directly in front of them.

Many occupations require that workers either maintain their arms steady while performing their tasks or require that they hold their arms in an elevated position for an extended period of time. Examples of such occupations are surgeons performing microscopic surgery, and persons working at computers, word processors, typewriters or the like.

Additionally, there is a degenerative disease called fibrositis, one of the characteristics of which is that, although the victim may be otherwise in relatively good physical condition, they have lost the muscular strength required to hold their arms in an elevated position.

The present invention provides a chair with easily adjustable armrests such that by resting their forearms on the armrest the operator can avoid fatigue, and in the case of those afflicted with the disease, continue working, in spite of the presence of fibrositis.

SUMMARY OF THE INVENTION

The present invention is directed toward a chair provided with adjustable armrests to support the arms of an operator in any one of a plurality of continuously variable horizontal positions.

In accordance with a preferred form of the invention, a chair is provided with an adjustable back member and a substantially U-shaped armrest support structure including a support bar on each side of the seat. One end of the bar is immovably attached to the seat, and the other end pivotally supports a padded armrest. The armrest is provided with a broad front portion and a narrow rear portion, and is mounted such that the front portion may pivot inward in a horizontal plane toward an operator sitting in the chair. The armrest and support bar are provided with cooperating means which define a pivot point for the armrest, and additional means which causes the armrest to frictionally engage the support bar and thus lock the armrest in position.

DETAILED DESCRIPTION OF THE PREFERRED EMBODIMENTS

Figure 1:
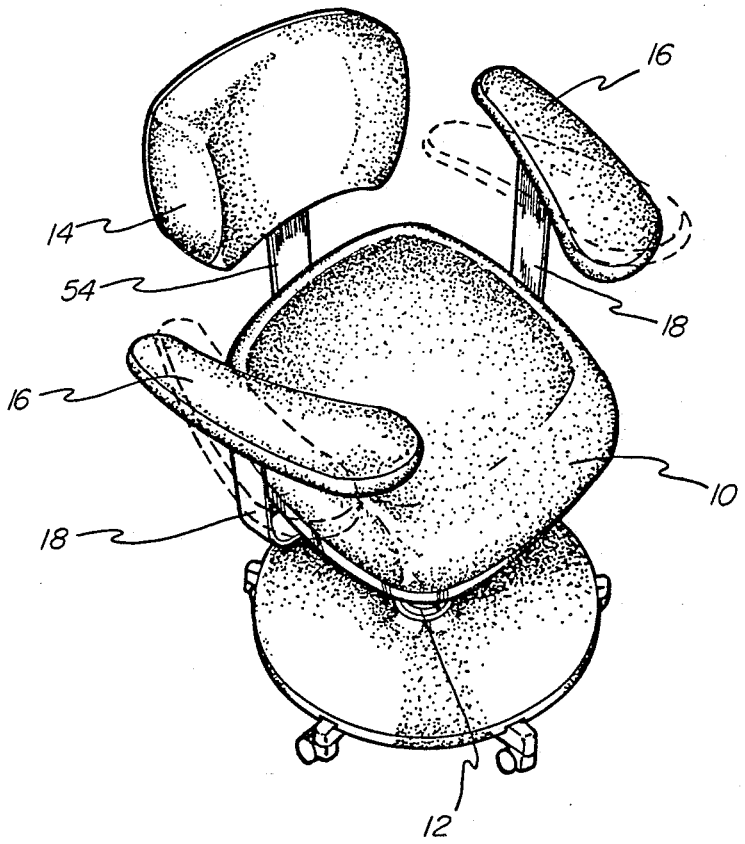
FIG. 1 is a perspective view of a chair according to the present invention showing the armrests pivoted outwardly in phantom.
Figure 2:
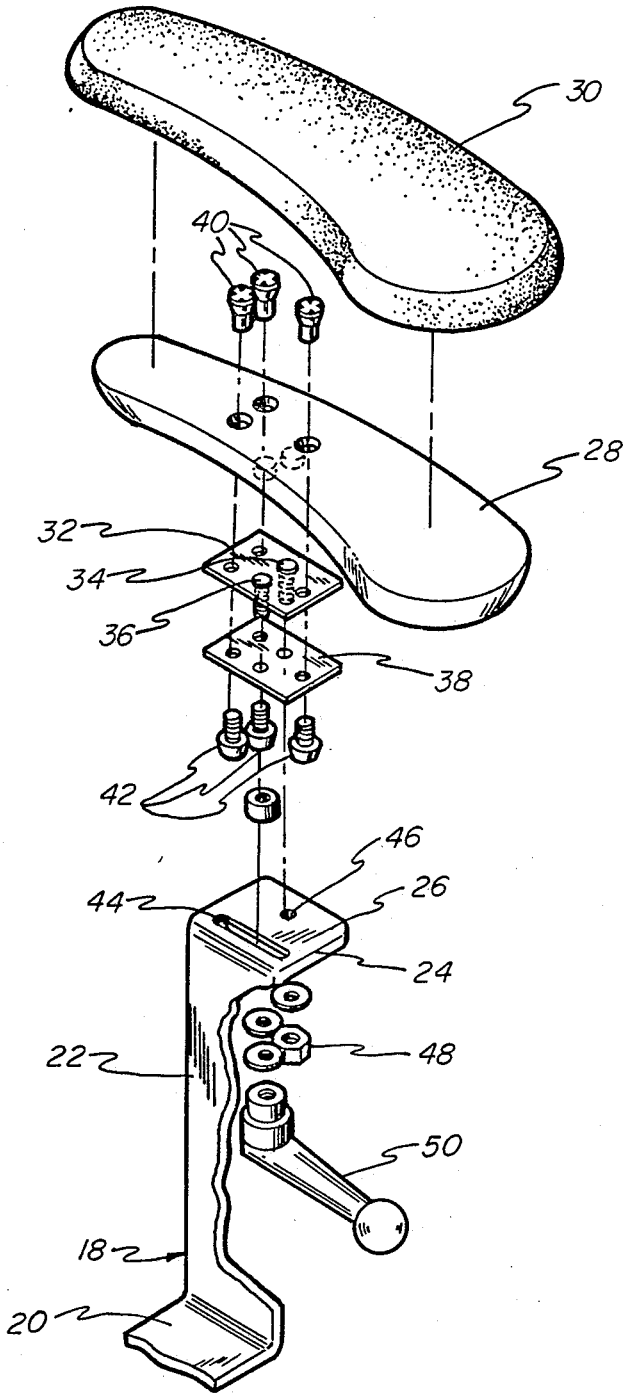
FIG. 2 is a perspective view of the chair showing an exploded view of the armrest components.

As seen in FIGS. 1 and 2, the chair of the present invention comprises a seat 10 supported by a pedestal 12, a chair back 14, armrests 16, and support bars 18 for supporting the armrests 16 on either side of the seat 10.

As illustrated in FIG. 1, the armrests 16 may be pivoted inwardly such that a front portion of each armrest overlies the seat 10. The armrests 16 may assume an outwardly pivoted position (as shown in phantom lines), allowing operators to sit in the seat 10, and any one of a plurality of inwardly pivoted operating positions which allow the operators to rest their arms on the armrests 16 with their hands directly in front of them. Thus, operators can perform tasks requiring cooperative use of both hands, such as microsurgery or typing, while comfortably resting their arms on the armrests 16.

The support bars 18 together form a substantially U-shaped structure. The support bars 18 each include a horizontal lower portion 20 which is immovably attached to the seat 10. A relatively long vertical extension 22 of the bar 18 extends vertically upwardly above the seat 10, and has formed integrally therewith a horizontal planar extension 24, which defines a support surface 26 for the armrest 16.

The armrests are formed as elongated members, with a wide front portion and a narrow rearward portion, and each includes a board 28 with a padded portion 30 attached to one side.

Means for mounting the armrests to the support bars are shown in FIG. 2. A mounting plate 32 is provided with two holes for receiving a threaded pivot bolt 34 and a threaded locking bolt 36. The bolts 34, 36 are rigidly attached to the mounting plate 32 by welding the heads of the bolts 34, 36 to the mounting plate 32 with their shanks passing through the holes. A pivot plate 38 provides a pivot surface for cooperation with the support surface 26 and also serves to attach the mounting plate 32 to the board 28 of the armrest 16. The mounting plate 32 is positioned between the board 28 and the pivot plate 38, and the two plates 32, 38 and the board 28 are provided with three aligned through holes. T-nuts 40 are positioned in the upper portion of the through holes in the board 28 and engage three plate attaching bolts 42 passing through both the pivot plate 38 and the mounting plate 32 to hold the plates 32, 38 to the board 28 in a position which is substantially intermediate the ends of the board 28.

The horizontal planar extension 24 of the support bar 18 is provided with a substantially straight guide slot 44 proximate to the vertical extension 22 and a pivot hole 46 distal from the vertical extension 22. The pivot bolt 34 passes through the pivot hole 46 and a nut 48 engages the end of the pivot bolt 34 to hold it in place. The pivot bolt 34, pivot hole 46 and nut 48 form a pivot point for the pivotal movement of the armrest 16.

The locking bolt 36 passes through the guide slot 44 and is engaged on its free end by a threaded aperture located on the end of an elongated lever 50. The diameter of the locking bolt 36 is less than the width of the guide slot 44, such that the locking bolt 36 may move along the length of the guide slot 44 in a slightly curved path without interfering with the sides of the guide slot 44. By rotating the lever 50 in a direction which tends to threadably engage the threaded aperture, the pivot plate 38 is pulled toward and frictionally engages with the support surface 26 such that the armrest 16 is prevented from pivoting. Rotation of the lever 50 in the opposite direction will tend to threadably disengage the threaded aperture and the armrest 16 will be free to pivot in a horizontal plane parallel to the support surface 26 to the extent permitted by the guide slot 44.

Figure 3:
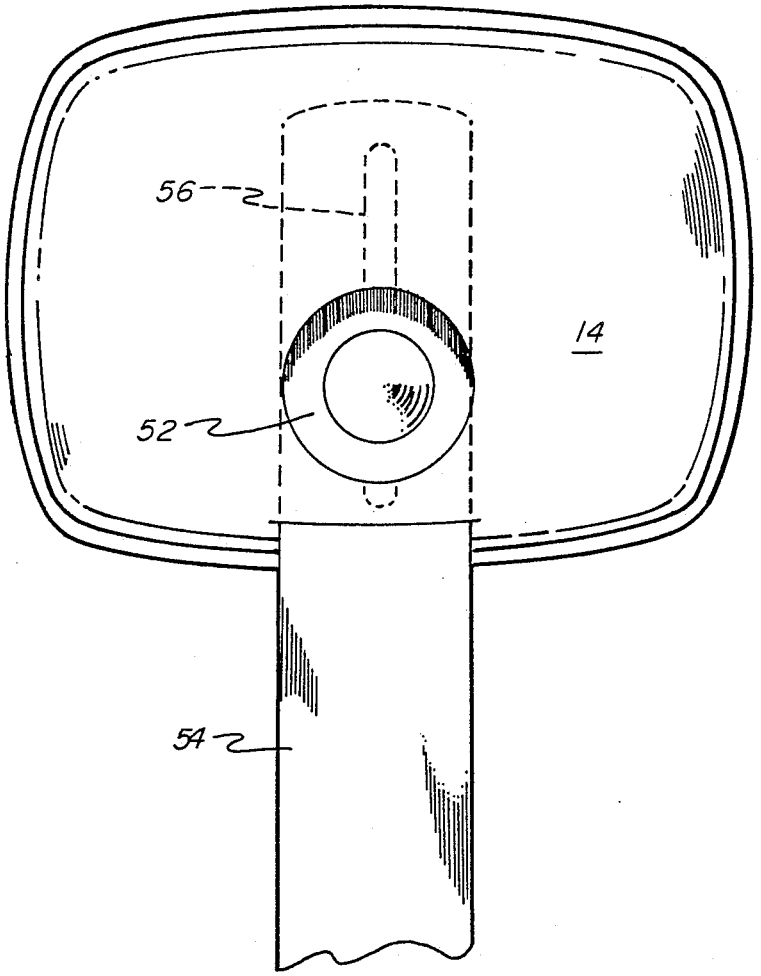
FIG. 3 is a rear view of the chair showing the backrest adjustment means.

As seen in FIG. 3, the chair back 14 receives a back support 54 within a slot such that the chair back 14 may be adjusted vertically along the back support 54. The chair back 14 includes a torque knob 52 having a shank which is received within a slot 56 in the back support 54. When the chair back 14 has been moved to a desired height, the torque knob 52 may be tightened to hold the back 14 in place.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. A chair comprising a seat and an armrest, a support member for supporting said armrest for pivotal movement, said support member having a lower horizontal portion immovably connected to said seat, a vertical extension extending vertically upward from said seat, and an upper horizontal planar extension connected to said vertical extension and defining a support surface for engaging a lower surface of said armrest said support surface including means defining therethrough a hole and a slot, said hole being positioned distal from said vertical extension and said slot being substantially straight slot located between said hole and said vertical extension and extending from a front to a rear portion of said planar extension, and pin means protruding from said armrest, said pin means including a first elongated member extending through said hole to define a pivot point for said armrest and a second elongated member extending through said slot for guiding said armrest in its pivotal movement said second elongated member including means to allow said second elongated member to move along said slot in a slightly curved guide path.

2. A chair according to claim 1, wherein said first and second elongated members comprise threaded bolts passing through said hole and said slot, said bolt passing through said hole forms a pivot point for said armrest, a nut is received on an end of said pivot point forming bolt, and a locking lever having a threaded aperture formed in an end thereof is received on said bolt passing through said slot, whereby rotation of said lever in a first direction will allow said armrest to pivot in horizontal plane about said pivot point, and rotation of said lever in a second direction will cause a bottom portion of said armrest to frictionally engage said support surface and lock said armrest in position.

3. A chair according to claim 1, wherein said armrest comprises a substantially planar board and a padded portion overlying one side of said board.

4. A chair according to claim 3 further comprising a mounting plate attached to said board and wherein said elongated members forming said pin means protruding from said armrest each include a head welded to said mounting plate.

5. A chair according to claim 4, wherein said armrest is elongated and said mounting plate is attached substantially intermediate the ends of said armrest.

6. A chair according to claim 4 further comprising a pivot plate having means defining holes therethrough and wherein said mounting plate is located between said board and said pivot plate and said pin means pass through said holes in said pivot plate.

7. A chair according to claim 6, further including means defining through holes in said board, T-nuts positioned in said through holes and bolts passing through said mounting plate and said pivot plate and engaging said T-nuts to attach said plates to said board.

8. A chair according to claim 1, including two armrests and two support members, wherein said support members each comprise a lower horizontal portion immovably connected to said seat, a vertical extension extending vertically upwardly from said seat, and an upper horizontal planar extension, said planar extension defining said support surface, and wherein said support members form a substantially U-shaped structure.

9. A chair having a support pedestal for supporting a seat, a vertically adjustable backrest attached to a back portion of said seat, and a pair of pivotable armrest assemblies attached to opposing sides of said seat and forming a substantially U-shaped structure, each armrest assembly comprising a support bar having a lower horizontal portion immovably connected to said seat and a vertical extension extending vertically upward from said seat, said support bar having an upper horizontal planar extension including a pivot hole distal from said vertical extension and a substantially straight guide slot proximate said vertical extension and extending from a front to a rear portion of said planar extension, an elongated armrest including a broad front portion and a narrow rearward portion, said armrest comprising a substantially planar board and a padded portion overlying one side of said board, means defining three through holes in said board, T-nuts positioned in said through holes, a mounting plate having defined therethrough two holes, pivot and locking bolts extending through said mounting plate holes, said bolts having heads welded to said mounting plate, said mounting plate being attached substantially intermediate the ends of said armrest board by means of a pivot plate and three plate attaching bolts passing through both said mounting plate and said pivot plate and engaging said T-nuts, said pivot plate having two holes through which said pivot bolt and locking bolt pass, said pivot bolt extending through said pivot hole forming a pivot point for said armrest and said locking bolt extending through said guide slot said locking bolt including means to allow said locking bolt to move along said guide slot in a slightly curved guide path, said pivot point including a nut on an end of said pivot bolt, an elongated lever having a threaded aperture at one end threadably receiving said locking bolt such that rotation of said lever in a first direction will allow said armrest to pivot in a horizontal plane about said pivot bolt, and rotation of said lever in a second direction will cause a bottom portion of said armrest to frictionally engage said planar extension and lock said armrest in position, said pivot and guide slot cooperating to permit movement of said front portion of said armrest inward from the sides of said chair to overlie said seat, such that operators sitting in said chair may rest their forearms on said armrests with their arms angled inward.

* * * * *

UNITED STATES PATENT AND TRADEMARK OFFICE

CERTIFICATE OF CORRECTION

PATENT NO. : 4,961,610

DATED : October 9, 1990

INVENTOR(S) : Ryan A. Reeder et al

It is certified that error appears in the above-identified patent and that said Letters Patent is hereby corrected as shown below:

Claim 1 - Column 3, line 20, after "being", insert the word --a--.

Signed and Sealed this

Seventh Day of January, 1992

*Attest:*

HARRY F. MANBECK, JR.

*Attesting Officer*

*Commissioner of Patents and Trademarks*